US009421780B2

(12) United States Patent
Nishiyama

(10) Patent No.: US 9,421,780 B2
(45) **Date of Patent: *Aug. 23, 2016**

(54) INK CIRCULATION TYPE INKJET PRINTER

(71) Applicant: RISO KAGAKU CORPORATION, Tokyo (JP)

(72) Inventor: Akira Nishiyama, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/858,458

(22) Filed: Sep. 18, 2015

(65) Prior Publication Data

US 2016/0089897 A1 Mar. 31, 2016

(30) Foreign Application Priority Data

Sep. 29, 2014 (JP) ..... 2014-198713

(51) Int. Cl.
*B41J 2/175* (2006.01)
*B41J 2/18* (2006.01)

(52) U.S. Cl.
CPC ..... *B41J 2/175* (2013.01); *B41J 2/17596* (2013.01); *B41J 2/18* (2013.01); *B41J 2/17566* (2013.01)

(58) Field of Classification Search
CPC .. B41J 2/175; B41J 2/17513; B41J 2/17509; B41J 2/17596; B41J 2/17553; B41J 2/18; B41J 2/17566
USPC ..... 347/85
See application file for complete search history.

(56) References Cited

U.S. PATENT DOCUMENTS 7,845,784 B2 12/2010 Nitta et al.
2009/0174735 A1* 7/2009 Yamada ..... B41J 2/175 347/7

FOREIGN PATENT DOCUMENTS

JP 2008-162262 A 7/2008

OTHER PUBLICATIONS

U.S. Appl. No. 14/742,902 to Hiroshi Sugitani et al., which was filed on Jun. 18, 2015.
U.S. Appl. No. 14/801,069 to Akira Nishiyama et al., which was filed on Jul. 16, 2015.
U.S. Appl. No. 14/849,883 to Hiroshi Sugitani et al., which was filed on Sep. 10, 2015.
U.S. Appl. No. 14/858,406 to Akira Nishiyama, which was filed on Sep. 18, 2015.
U.S. Appl. No. 14/743,164 to Hiroyuki Nakamura, which was filed on Jun. 18, 2015.

* cited by examiner

*Primary Examiner* — Manish S Shah
*Assistant Examiner* — Yaovi M Ameh
(74) *Attorney, Agent, or Firm* — Greenblum & Bernstein P.L.C.

(57) ABSTRACT

An inkjet printer includes: an inkjet head including a nozzle configured to eject ink; a positive pressure tank configured to store the ink to be supplied to the inkjet head; a negative pressure tank configured to receive the ink not consumed by the inkjet head; an ink deliverer configured to deliver the ink from the negative pressure tank to the positive pressure tank; a pressure regulator configured to regulate pressures of the positive pressure tank and the negative pressure tank; and a controller configured to control the ink deliverer and the pressure regulator such that an ink delivery operation by the ink deliverer and a pressure regulation operation by the pressure regulator are performed separately in time.

15 Claims, 9 Drawing Sheets

FIG. 3

| PRESSURE CONDITIONS | CONTROL ELEMENT | | |
|---|---|---|---|
| | AIR PUMP | POSITIVE PRESSURE TANK PRESSURE REGULATION VALVE | NEGATIVE PRESSURE TANK PRESSURE REGULATION VALVE |
| $Pk<Pks$ AND $\lvert Pf\rvert<\lvert Pfs\rvert$ | DRIVEN | CLOSED | CLOSED |
| $Pk\geq Pks$ AND $\lvert Pf\rvert<\lvert Pfs\rvert$ | DRIVEN | OPENED | CLOSED |
| $Pk<Pks$ AND $\lvert Pf\rvert\geq\lvert Pfs\rvert$ | DRIVEN | CLOSED | OPENED |
| $Pk\geq Pks$ AND $\lvert Pf\rvert\geq\lvert Pfs\rvert$ | STOPPED | OPENED | OPENED |

FIG. 4

| LIQUID LEVEL CONDITIONS | CONTROL ELEMENT | |
|---|---|---|
| | INK SUPPLY VALVE | INK PUMP |
| POSITIVE PRESSURE TANK LIQUID LEVEL SENSOR: OFF<br>NEGATIVE PRESSURE TANK LIQUID LEVEL SENSOR: OFF | OPENED | STOPPED |
| POSITIVE PRESSURE TANK LIQUID LEVEL SENSOR: ON<br>NEGATIVE PRESSURE TANK LIQUID LEVEL SENSOR: OFF | CLOSED | STOPPED |
| POSITIVE PRESSURE TANK LIQUID LEVEL SENSOR: OFF<br>NEGATIVE PRESSURE TANK LIQUID LEVEL SENSOR: ON | CLOSED | DRIVEN |
| POSITIVE PRESSURE TANK LIQUID LEVEL SENSOR: ON<br>NEGATIVE PRESSURE TANK LIQUID LEVEL SENSOR: ON | CLOSED | STOPPED |

FIG. 5

| COMBINATORIAL CONDITION NUMBER | PRESSURE CONDITIONS | LIQUID LEVEL CONDITIONS | CONTROL ELEMENT | | | | |
|---|---|---|---|---|---|---|---|
| | | | AIR PUMP | POSITIVE PRESSURE TANK PRESSURE REGULATION VALVE | NEGATIVE PRESSURE TANK PRESSURE REGULATION VALVE | INK SUPPLY VALVE | INK PUMP |
| K-1 | Pk<Pks AND \|Pf\|<\|Pfs\| | POSITIVE PRESSURE TANK LIQUID LEVEL SENSOR: OFF<br>NEGATIVE PRESSURE TANK LIQUID LEVEL SENSOR: OFF | FIRST SEPARATIVE OPERATION | CLOSED | CLOSED | FIRST SEPARATIVE OPERATION | STOPPED |
| K-2 | Pk<Pks AND \|Pf\|<\|Pfs\| | POSITIVE PRESSURE TANK LIQUID LEVEL SENSOR: ON<br>NEGATIVE PRESSURE TANK LIQUID LEVEL SENSOR: OFF | DRIVEN | CLOSED | CLOSED | CLOSED | STOPPED |
| K-3 | Pk<Pks AND \|Pf\|<\|Pfs\| | POSITIVE PRESSURE TANK LIQUID LEVEL SENSOR: OFF<br>NEGATIVE PRESSURE TANK LIQUID LEVEL SENSOR: ON | FIFTH SEPARATIVE OPERATION | CLOSED | CLOSED | CLOSED | FIFTH SEPARATIVE OPERATION |
| K-4 | Pk<Pks AND \|Pf\|<\|Pfs\| | POSITIVE PRESSURE TANK LIQUID LEVEL SENSOR: ON<br>NEGATIVE PRESSURE TANK LIQUID LEVEL SENSOR: ON | DRIVEN | CLOSED | CLOSED | CLOSED | STOPPED |
| K-5 | Pk≥Pks AND \|Pf\|<\|Pfs\| | POSITIVE PRESSURE TANK LIQUID LEVEL SENSOR: OFF<br>NEGATIVE PRESSURE TANK LIQUID LEVEL SENSOR: OFF | SECOND SEPARATIVE OPERATION | SECOND SEPARATIVE OPERATION | CLOSED | SECOND SEPARATIVE OPERATION | STOPPED |
| K-6 | Pk≥Pks AND \|Pf\|<\|Pfs\| | POSITIVE PRESSURE TANK LIQUID LEVEL SENSOR: ON<br>NEGATIVE PRESSURE TANK LIQUID LEVEL SENSOR: OFF | DRIVEN | OPENED | CLOSED | CLOSED | STOPPED |
| K-7 | Pk≥Pks AND \|Pf\|<\|Pfs\| | POSITIVE PRESSURE TANK LIQUID LEVEL SENSOR: OFF<br>NEGATIVE PRESSURE TANK LIQUID LEVEL SENSOR: ON | SIXTH SEPARATIVE OPERATION | SIXTH SEPARATIVE OPERATION | CLOSED | CLOSED | SIXTH SEPARATIVE OPERATION |
| K-8 | Pk≥Pks AND \|Pf\|<\|Pfs\| | POSITIVE PRESSURE TANK LIQUID LEVEL SENSOR: ON<br>NEGATIVE PRESSURE TANK LIQUID LEVEL SENSOR: ON | DRIVEN | OPENED | CLOSED | CLOSED | STOPPED |

FIG. 6

| COMBINATORIAL CONDITION NUMBER | PRESSURE CONDITIONS | LIQUID LEVEL CONDITIONS | CONTROL ELEMENT | | | | |
|---|---|---|---|---|---|---|---|
| | | | AIR PUMP | POSITIVE PRESSURE TANK PRESSURE REGULATION VALVE | NEGATIVE PRESSURE TANK PRESSURE REGULATION VALVE | INK SUPPLY VALVE | INK PUMP |
| K-9 | Pk<Pks AND \|Pf\|≥\|Pfs\| | POSITIVE PRESSURE TANK LIQUID LEVEL SENSOR: OFF<br>NEGATIVE PRESSURE TANK LIQUID LEVEL SENSOR: OFF | THIRD SEPARATIVE OPERATION | CLOSED | THIRD SEPARATIVE OPERATION | THIRD SEPARATIVE OPERATION | STOPPED |
| K-10 | Pk<Pks AND \|Pf\|≥\|Pfs\| | POSITIVE PRESSURE TANK LIQUID LEVEL SENSOR: ON<br>NEGATIVE PRESSURE TANK LIQUID LEVEL SENSOR: OFF | DRIVEN | CLOSED | OPENED | CLOSED | STOPPED |
| K-11 | Pk<Pks AND \|Pf\|≥\|Pfs\| | POSITIVE PRESSURE TANK LIQUID LEVEL SENSOR: OFF<br>NEGATIVE PRESSURE TANK LIQUID LEVEL SENSOR: ON | SEVENTH SEPARATIVE OPERATION | CLOSED | SEVENTH SEPARATIVE OPERATION | CLOSED | SEVENTH SEPARATIVE OPERATION |
| K-12 | Pk<Pks AND \|Pf\|≥\|Pfs\| | POSITIVE PRESSURE TANK LIQUID LEVEL SENSOR: ON<br>NEGATIVE PRESSURE TANK LIQUID LEVEL SENSOR: ON | DRIVEN | CLOSED | OPENED | CLOSED | STOPPED |
| K-13 | Pk≥Pks AND \|Pf\|≥\|Pfs\| | POSITIVE PRESSURE TANK LIQUID LEVEL SENSOR: OFF<br>NEGATIVE PRESSURE TANK LIQUID LEVEL SENSOR: OFF | STOPPED | FOURTH SEPARATIVE OPERATION | FOURTH SEPARATIVE OPERATION | FOURTH SEPARATIVE OPERATION | STOPPED |
| K-14 | Pk≥Pks AND \|Pf\|≥\|Pfs\| | POSITIVE PRESSURE TANK LIQUID LEVEL SENSOR: ON<br>NEGATIVE PRESSURE TANK LIQUID LEVEL SENSOR: OFF | STOPPED | OPENED | OPENED | CLOSED | STOPPED |
| K-15 | Pk≥Pks AND \|Pf\|≥\|Pfs\| | POSITIVE PRESSURE TANK LIQUID LEVEL SENSOR: OFF<br>NEGATIVE PRESSURE TANK LIQUID LEVEL SENSOR: ON | STOPPED | EIGHTH SEPARATIVE OPERATION | EIGHTH SEPARATIVE OPERATION | CLOSED | EIGHTH SEPARATIVE OPERATION |
| K-16 | Pk≥Pks AND \|Pf\|≥\|Pfs\| | POSITIVE PRESSURE TANK LIQUID LEVEL SENSOR: ON<br>NEGATIVE PRESSURE TANK LIQUID LEVEL SENSOR: ON | STOPPED | OPENED | OPENED | CLOSED | STOPPED |

INK CIRCULATION TYPE INKJET PRINTER

CROSS REFERENCE TO RELATED APPLICATION

This application is based upon and claims the benefit of priority from the prior Japanese Patent Application No. 2014-198713, filed on Sep. 29, 2014, the entire contents of which are incorporated herein by reference.

BACKGROUND

1. Technical Field

The disclosure relates to an ink circulation type inkjet printer.

2. Related Art

Japanese Unexamined Patent Application Publication No. 2008-162262 describes an ink circulation type inkjet printer that performs printing by ejecting ink from an inkjet head while circulating the ink.

In some ink circulation type inkjet printers, ink is circulated by an air pump applying a positive pressure and a negative pressure to a positive pressure tank and a negative pressure tank, respectively, the positive pressure tank being disposed upstream of the inkjet head, the negative pressure tank being disposed downstream of the inkjet head.

When such an inkjet printer performs printing, the air pump applies a positive pressure and a negative pressure respectively to the positive pressure tank and the negative pressure tank, both of which are set in a sealed state Thus, the ink flows from the positive pressure tank to the inkjet head. The ink, which is not consumed by the inkjet head, is collected by the negative pressure tank. Also, the ink is delivered from the negative pressure tank to the positive pressure tank by an ink pump according to the liquid level heights in the positive pressure tank and the negative pressure tank. In this manner, the ink is circulated.

During the circulation of ink, the pressures in the ink tanks (the positive pressure tank, the negative pressure tank) are regulated in order to ensure a circulation flow rate (flow volume) and to maintain a nozzle pressure of the inkjet head at an appropriate value. The pressures are regulated, for instance, by driving the air pump and opening/closing a pressure regulation valve.

SUMMARY

In the above-described inkjet printer, variations in the pressures of the positive pressure tank and the negative pressure tank may increase due to an concurrence of a pressure regulation operation by the air pump or the like and any pressure variation factor other than the pressure regulation operation. The pressure variation factors other than the pressure regulation operation include, for instance, an ink delivery operation by an ink pump. When ink is delivered from the negative pressure tank to the positive pressure tank by an ink delivery operation, the liquid levels of the positive pressure tank and the negative pressure tank vary, and the pressure varies accordingly.

When a variation in the liquid levels of the positive pressure tank and the negative pressure tank increases, a variation in the nozzle pressure increases. Consequently, ejection of ink becomes unstable and printed image quality may be degraded.

The disclosure aims to provide an inkjet printer that can reduce degradation of printed image quality.

An inkjet printer in accordance with some embodiments includes: an inkjet head including a nozzle configured to eject ink; a positive pressure tank configured to store the ink to be supplied to the inkjet head; a negative pressure tank configured to receive the ink not consumed by the inkjet head; an ink deliverer configured to deliver the ink from the negative pressure tank to the positive pressure tank; a pressure regulator configured to regulate pressures of the positive pressure tank and the negative pressure tank; and a controller configured to control the ink deliverer and the pressure regulator such that an ink delivery operation by the ink deliverer and a pressure regulation operation by the pressure regulator are performed separately in time.

With the configuration described above, the ink delivery operation and the pressure regulation operation are performed separately in time, and thus increase in the nozzle pressure variation can be suppressed. Consequently, degradation of printed image quality can be reduced.

The inkjet printer may further include an ink supplier configured to supply the ink to the negative pressure tank. The controller may be configured to control the ink supplier and the pressure regulator such that an ink supply operation by the ink supplier and the pressure regulation operation by the pressure regulator are performed separately in time.

With the configuration described above, the ink supply operation and the pressure regulation operation are performed separately in time, and thus increase in the nozzle pressure variation can be further suppressed. Consequently, degradation of printed image quality can be further reduced.

An inkjet printer in accordance with some embodiments includes: an inkjet head including a nozzle configured to eject ink; a positive pressure tank configured to store the ink to be supplied to the inkjet head; a negative pressure tank configured to receive the ink not consumed by the inkjet head; an ink deliverer configured to deliver the ink from the negative pressure tank to the positive pressure tank; an ink supplier configured to supply the ink to the negative pressure tank; a pressure regulator configured to regulate pressures of the positive pressure tank and the negative pressure tank; and a controller configured to control the ink supplier and the pressure regulator such that an ink supply operation by the ink supplier and a pressure regulation operation by the pressure regulator are performed separately in time.

With the configuration described above, the ink supply operation and the pressure regulation operation are performed separately in time, and thus increase in the nozzle pressure variation can be suppressed. Consequently, degradation of printed image quality can be reduced.

The controller may be configured to control the ink supplier and the ink deliverer such that the ink supply operation by the ink supplier and the ink delivery operation by the ink deliverer are performed separately in time.

With the configuration described above, the ink delivery operation and the ink supply operation are performed separately in time, and thus increase in the nozzle pressure variation can be further suppressed. Consequently, degradation of printed image quality can be further reduced.

BRIEF DESCRIPTION OF DRAWINGS

FIG. 3 is an explanatory diagram of pressure control.

FIG. 4 is an explanatory diagram of liquid level control.

FIG. 5 is an explanatory diagram of pressure liquid level control.

FIG. 6 is an explanatory diagram of the pressure liquid level control.

DETAILED DESCRIPTION

Figure 1:
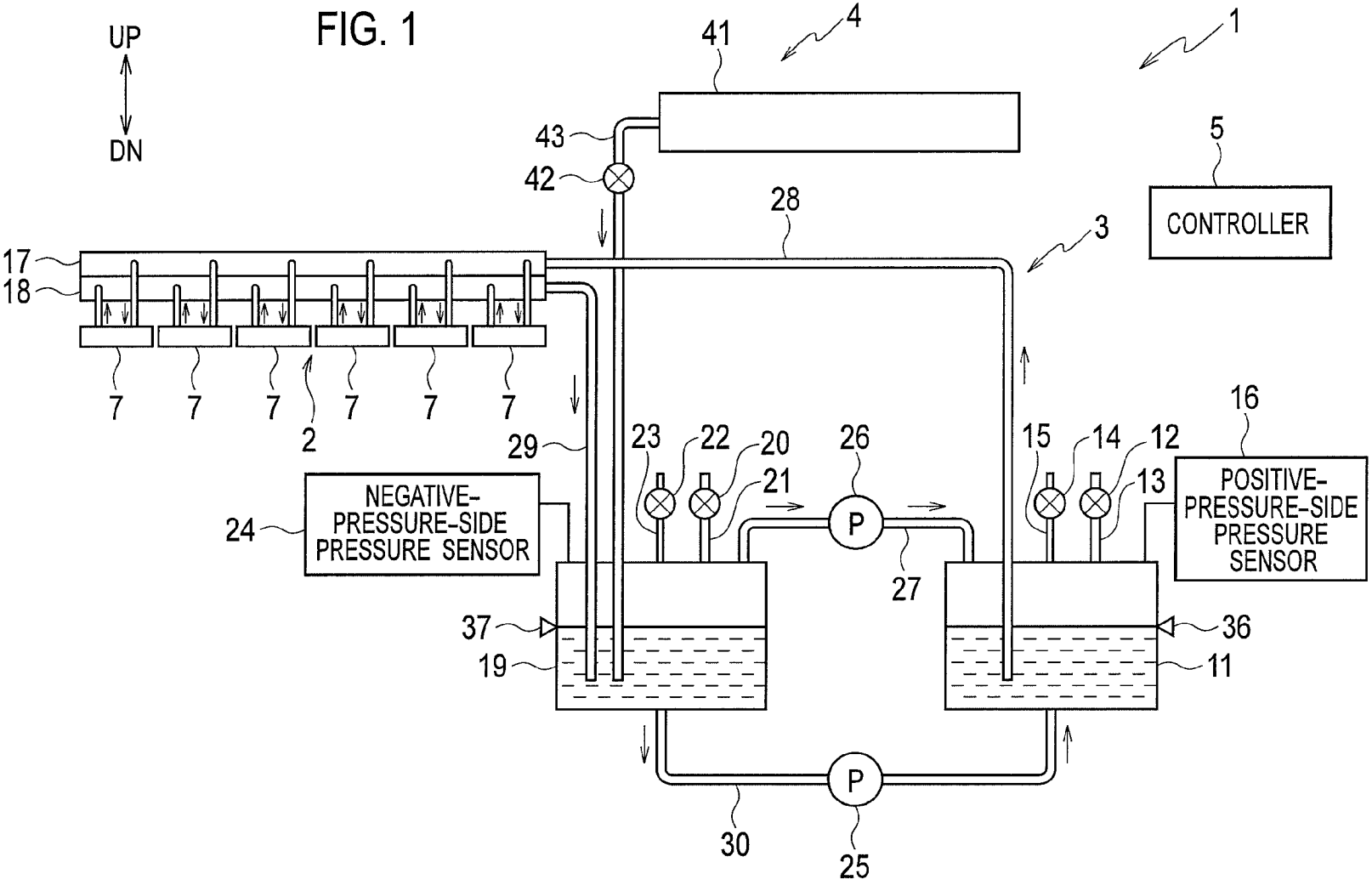
FIG. 1 is a schematic configuration diagram of an inkjet printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

FIG. 1 is a schematic configuration diagram of an inkjet printer according to an embodiment of the present disclosure. It is to be noted that the upward and downward directions in the following description indicate the vertical direction and in FIG. 1, UP indicates the upward direction and DN indicates the downward direction.

As illustrated in FIG. 1, an inkjet printer 1 according to the present embodiment includes an inkjet head 2, an ink circulation unit 3, an ink supply unit 4, and a controller 5.

The inkjet head 2 ejects ink which is supplied by the ink circulation unit 3. The inkjet head 2 includes plural head modules 7.

The head modules 7 each have an ink chamber (not illustrated) that stores ink and plural nozzles (not illustrated) through which ink is ejected. A piezoelectric element (not illustrated) is disposed in the ink chamber. Ink is ejected through a nozzle by driving the piezoelectric element.

The ink circulation unit 3 supplies ink to the inkjet head 2 while circulating ink. The ink circulation unit 3 includes a positive pressure tank 11, a positive pressure tank air opening valve 12, a positive pressure tank air opening pipe 13, a positive pressure tank pressure regulation valve 14, a positive pressure tank pressure regulation pipe 15, a positive-pressure-side pressure sensor 16, an ink distributor 17, an ink collector 18, a negative pressure tank 19, a negative pressure tank air opening valve 20, a negative pressure tank air opening pipe 21, a negative pressure tank pressure regulation valve 22, a negative pressure tank pressure regulation pipe 23, a negative-pressure-side pressure sensor 24, an ink pump 25, an air pump 26, a pipe 27 for air pump, and ink circulation pipes 28 to 30.

The positive pressure tank 11 stores ink to be supplied to the inkjet head 2. The ink in the positive pressure tank 11 is supplied to the inkjet head 2 through the ink circulation pipe 28 and the ink distributor 17. An air layer is formed on the liquid level of the ink in the positive pressure tank 11. The positive pressure tank 11 is disposed at a position lower than (under) the inkjet head 2.

The positive pressure tank 11 is provided with a positive pressure tank liquid level sensor 36. The positive pressure tank liquid level sensor 36 is for determining whether or not the liquid level height of the ink in the positive pressure tank 11 has reached a reference height. When the liquid level height of the ink in the positive pressure tank 11 is greater than or equal to a reference height, the positive pressure tank liquid level sensor 36 outputs a signal that indicates "ON" and when the liquid level height of the ink is less than the reference height, the positive pressure tank liquid level sensor 36 outputs a signal that indicates "OFF".

The positive pressure tank air opening valve 12 opens and closes a flow path of the air in the positive pressure tank air opening pipe 13 for switching between a sealed state (sealed state from the atmosphere) and an air open state (open state to the atmosphere) of the positive pressure tank 11. The positive pressure tank air opening valve 12 is disposed midway along the positive pressure tank air opening pipe 13.

The positive pressure tank air opening pipe 13 forms a flow path of air for opening the positive pressure tank 11 to the atmosphere. The positive pressure tank air opening pipe 13 has one end connected to the air layer of the positive pressure tank 11 and the other end communicating with the atmosphere.

The positive pressure tank pressure regulation valve 14 (part of the pressure regulator) opens and closes the flow path of the air in the positive pressure tank pressure regulation pipe 15 in order to regulate the pressure in the positive pressure tank 11. The positive pressure tank pressure regulation valve 14 is provided midway along the positive pressure tank pressure regulation pipe 15.

The positive pressure tank pressure regulation pipe 15 forms a flow path of air for regulating the pressure in the positive pressure tank 11. The positive pressure tank pressure regulation pipe 15 is formed of a pipe having a higher flow path resistance than that of the positive pressure tank air opening pipe 13. Specifically, the positive pressure tank pressure regulation pipe 15 is formed of a pipe narrower than the positive pressure tank air opening pipe 13. The positive pressure tank pressure regulation pipe 15 has one end connected to the air layer of the positive pressure tank 11 and the other end communicating with the atmosphere.

The positive-pressure-side pressure sensor 16 detects the pressure in the positive pressure tank 11.

The ink distributor 17 distributes the ink supplied from the pressure tank 11 to each head module 7 of the inkjet head 2 through the ink circulation pipe 28.

The ink collector 18 collects from each head module 7 the ink that has not been consumed by the inkjet head 2. The ink collected by the ink collector 18 flows to the negative pressure tank 19 through the ink circulation pipe 29.

The negative pressure tank 19 receives and stores the ink that has not been consumed by the inkjet head 2, from the ink collector 18. In addition, the negative pressure tank 19 stores the ink that is supplied from an ink cartridge 41 of the later-described ink supply unit 4. An air layer is formed on the liquid level of the ink in the negative pressure tank 19.

The negative pressure tank 19 is disposed at the same height as the positive pressure tank 11.

The negative pressure tank 19 is provided with a negative pressure tank liquid level sensor 37. The negative pressure tank liquid level sensor 37 is for determining whether or not the liquid level height of the ink in the negative pressure tank 19 has reached a reference height. When the liquid level height of the ink in the negative pressure tank 19 is greater than or equal to a reference height, the negative pressure tank liquid level sensor 37 outputs a signal that indicates "ON" and when the liquid level height of the ink is less than the reference height, the negative pressure tank liquid level sensor 37 outputs a signal that indicates "OFF".

The negative pressure tank air opening valve 20 opens and closes a flow path of the air in the negative pressure tank air opening pipe 21 for switching between a sealed state and an air open state of the negative pressure tank 19. The negative pressure tank air opening valve 20 is provided midway along the negative pressure tank air opening pipe 21.

The negative pressure tank air opening pipe 21 forms a flow path of air for opening the negative pressure tank 19 to the atmosphere. The negative pressure tank air opening pipe 21 has one end connected to the air layer of the negative pressure tank 19 and the other end communicating with the atmosphere.

The negative pressure tank pressure regulation valve 22 (part of the pressure regulator) opens and closes the flow path of the air in the negative pressure tank pressure regulation pipe 23 in order to regulate the pressure in the negative pressure tank 19. The negative pressure tank pressure regulation valve 22 is provided midway along the negative pressure tank pressure regulation pipe 23.

The negative pressure tank pressure regulation pipe 23 forms a flow path of air for regulating the pressure in the negative pressure tank 19. The negative pressure tank pressure regulation pipe 23 is formed of a pipe having a higher flow path resistance than that of the negative pressure tank air opening pipe 21. Specifically, the negative pressure tank pressure regulation pipe 23 is formed of a pipe which is narrower than the negative pressure tank air opening pipe 21 and has approximately the same thickness as the positive pressure tank pressure regulation pipe 15. The negative pressure tank pressure regulation pipe 23 has one end connected to the air layer of the negative pressure tank 19 and the other end communicating with the atmosphere.

The negative-pressure-side pressure sensor 24 detects the pressure in the negative pressure tank 19.

The ink pump 25 (ink deliverer) delivers ink from the negative pressure tank 19 to the positive pressure tank 11. The ink pump 25 is provided midway along the ink circulation pipe 30.

The air pump 26 (part of the pressure regulator) delivers air from the negative pressure tank 19 to the positive pressure tank 11, thereby generating pressures for ink circulation in the positive pressure tank 11 and the negative pressure tank 19. In addition, the air pump 26 is used for pressure regulation to maintain the pressures of the positive pressure tank 11 and the negative pressure tank 19 at nearly a constant level during ink circulation. The air pump 26 is disposed midway along the pipe 27 for air pump.

The pipe 27 for air pump forms a flow path of the air that is delivered from the negative pressure tank 19 to the positive pressure tank 11 by the air pump 26. The pipe 27 for air pump has one end connected to the air layer of the negative pressure tank 19 and the other end connected to the air layer of the positive pressure tank 11.

The ink circulation pipe 28 connects the positive pressure tank 11 and the ink distributor 17. In the ink circulation pipe 28, ink flows from the positive pressure tank 11 to the ink distributor 17. The ink circulation pipe 29 connects the ink collector 18 and the negative pressure tank 19. In the ink circulation pipe 29, ink flows from the ink collector 18 to the negative pressure tank 19. The ink circulation pipe 30 connects the negative pressure tank 19 and the positive pressure tank 11. In the ink circulation pipe 30, ink flows from the negative pressure tank 19 to the positive pressure tank 11. The ink circulation pipes 28 to 30, the ink distributor 17, and the ink collector 18 constitute a circulation path for circulating ink between the positive pressure tank 11, the inkjet head 2, and the negative pressure tank 19.

The ink supply unit 4 supplies ink to the negative pressure tank 19 of the ink circulation unit 3. The ink supply unit 4 includes an ink cartridge 41, an ink supply valve 42, and an ink supply pipe 43.

The ink cartridge 41 stores ink to be used in printing by the inkjet head 2. The ink in the ink cartridge 41 is supplied to the negative pressure tank 19 of the ink circulation unit 3 through the ink supply pipe 43.

The ink supply valve 42 opens and closes the flow path of ink in the ink supply pipe 43. When ink is supplied to the negative pressure tank 19, the ink supply valve 42 is opened.

The ink supply pipe 43 connects the ink cartridge 41 and the negative pressure tank 19. In the ink supply pipe 43, ink flows from the ink cartridge 41 to the negative pressure tank 19.

The controller 5 controls the operation of each component of the inkjet printer 1. The controller 5 includes a storage unit such as a CPU, a RAM, a ROM, and a hard disk. The controller 5 achieves the control (function) described below by executing a desirable program that is stored in the storage unit to be used in the present device.

The controller 5 causes the inkjet head 2 to eject ink and performs printing while circulating ink in the ink circulation unit 3. During the circulation of ink, the controller 5 performs control such that the ink delivery operation by the ink pump 25, the ink supply operation by the ink supply unit 4, and the pressure regulation operation by the air pump 26, the positive pressure tank pressure regulation valve 14, and the negative pressure tank pressure regulation valve 22 are performed separately in time.

Next, the operation of the inkjet printer 1 will be described.

Figure 2:
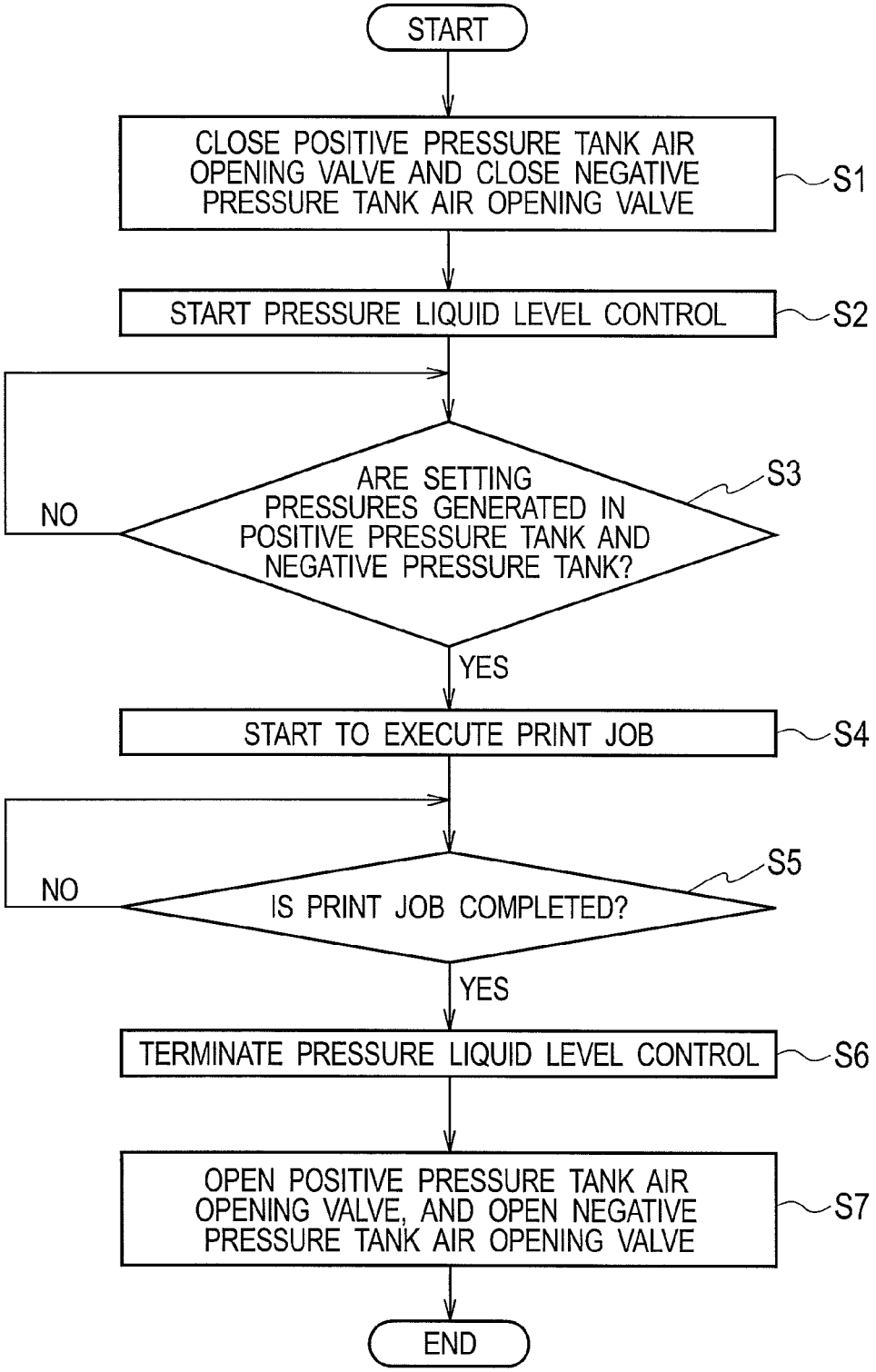
FIG. 2 is a flow chart for explaining the operation of the inkjet printer illustrated in FIG. 1.

FIG. 2 is a flow chart for explaining the operation of the inkjet printer 1. The processing of the flow chart of FIG. 2 starts when a print job is inputted to the inkjet printer 1.

In step S1 of FIG. 2, the controller 5 closes the positive pressure tank air opening valve 12 and the negative pressure tank air opening valve 20. Thus, the positive pressure tank 11 and the negative pressure tank 19 each assumes a sealed state. It is to be noted that during standby in which the inkjet printer 1 is not in operation, the positive pressure tank air opening valve 12 and the negative pressure tank air opening valve 20 are open. The positive pressure tank pressure regulation valve 14 and the negative pressure tank pressure regulation valve 22 are closed during standby.

Subsequently, in step S2, the controller 5 starts pressure liquid level control. The pressure liquid level control is for generating respective setting pressures Pks, Pfs for the positive pressure tank 11 and the negative pressure tank 19 and circulating ink while maintaining the setting pressures. The details of the pressure liquid level control will be described later.

The setting pressures Pks, Pfs are predetermined values of the pressure that sets the nozzle pressure of the inkjet head 2 to an appropriate value while causing circulation of ink. The setting pressure Pks for the positive pressure tank 11 is a positive pressure and the setting pressure Pfs for the negative pressure tank 19 is a negative pressure.

Subsequently, in step S3, the controller 5 determines whether or not the setting pressures Pks, Pfs have been generated in the positive pressure tank 11 and the negative pressure tank 19. When it is determined that the setting pressures Pks, Pfs have not been generated in the positive pressure tank 11 and the negative pressure tank 19 (NO in step S3), the controller 5 repeats step S3, When it is determined that the setting pressures Pks, Pfs have been generated in the positive pressure tank 11 and the negative pressure tank 19 (YES in step S3), the controller 5 starts to execute a print job. Specifically, the controller 5 ejects ink from the inkjet head 2 and prints an image on a sheet of paper based on the print job.

Subsequently, in step S5, the controller 5 determines whether or not the print job is completed. When it is determined that the print job is not completed (NO in step S5), the controller 5 repeats step S5.

When it is determined that the print job is completed (YES in step S5), the controller 5 terminates the pressure liquid level control in step S6.

Subsequently, in step S7, after the print job is completed, the controller 5 opens the positive pressure tank air opening valve 12 and the negative pressure tank air opening valve 20. Thus, a series of operations is completed and the inkjet printer 1 is set in a standby state.

Next, the pressure liquid level control started in the above-described step S2 of FIG. 2 will be described. The pressure liquid level control combines pressure control and liquid level control. First, the pressure control and the liquid level control will be separately described.

The pressure control is control that causes the air pump 26, the positive pressure tank pressure regulation valve 14, and the negative pressure tank pressure regulation valve 22 to perform a pressure regulation operation according to a pressure condition. The pressure condition includes a combination of a magnitude relationship between value Pk detected by the positive-pressure-side pressure sensor 16 and the setting pressure Pks of the positive pressure tank 11, and a magnitude relationship between value Pf detected by the negative-pressure-side pressure sensor 24 and the setting pressure Pfs of the negative pressure tank 19.

Specifically, as illustrated in FIG. 3, when Pk<Pks and lPfl<lPfsl, the positive pressure tank pressure regulation valve 14 and the negative pressure tank pressure regulation valve 22 are closed and the air pump 26 is driven. Thus, air is delivered by the air pump 26 from the negative pressure tank 19 to the positive pressure tank 11 both in a sealed state, and thereby the pressure of the negative pressure tank 19 is decreased and the pressure of the positive pressure tank 11 is increased.

When Pk≥Pks and lPfl<lPfsl, the positive pressure tank pressure regulation valve 14 is opened and the negative pressure tank pressure regulation valve 22 is closed. The air pump 26 is driven. Thus, air flows out from the positive pressure tank 11 through the positive pressure tank pressure regulation pipe 15, and thereby the pressure of the positive pressure tank 11 is decreased. Also, air is sucked by the air pump 26 from the negative pressure tank 19 in a sealed state, and thereby the pressure of the negative pressure tank 19 is decreased.

When Pk<Pks and lPfl≥lPfsl, the positive pressure tank pressure regulation valve 14 is closed and the negative pressure tank pressure regulation valve 22 is opened. The air pump 26 is driven. Thus, air is delivered by the air pump 26 to the positive pressure tank 11 in a sealed state, and thereby the pressure of the positive pressure tank 11 is increased. Also, air flows into the negative pressure tank 19 through the negative pressure tank pressure regulation pipe 23, and thereby the pressure of the negative pressure tank 19 is increased.

When Pk≥Pks and lPfl≥lPfsl, the positive pressure tank pressure regulation valve 14 and the negative pressure tank pressure regulation valve 22 are opened, and the air pump 26 is stopped. Thus, air flows out from the positive pressure tank 11 through the positive pressure tank pressure regulation pipe 15, and thereby the pressure of the positive pressure tank 11 is decreased. Also, air flows into the negative pressure tank 19 through the negative pressure tank pressure regulation pipe 23, and thereby the pressure of the negative pressure tank 19 is increased.

Next, the liquid level control will be described. The liquid level control is control that causes the ink supply unit 4 and the ink pump 25 to perform an ink supply operation and liquid delivery operation, respectively according to a liquid level condition in order to maintain the liquid level heights of the positive pressure tank 11 and the negative pressure tank 19. The liquid level condition includes a combination of ON/OFF state indicated by the positive pressure tank liquid level sensor 36 and ON/OFF state indicated by the negative pressure tank liquid level sensor 37.

Specifically, as illustrated in FIG. 4, when the positive pressure tank liquid level sensor 36 indicates OFF and the negative pressure tank liquid level sensor 37 indicates OFF, the ink supply valve 42 of the ink supply unit 4 is opened. Thus, ink is supplied to the negative pressure tank 19. The ink pump 25 is stopped and ink is not delivered from the negative pressure tank 19 to the positive pressure tank 11.

When the positive pressure tank liquid level sensor 36 indicates ON and the negative pressure tank liquid level sensor 37 indicates OFF, the ink supply valve 42 is closed and the ink pump 25 is stopped. The same operation is also performed when the positive pressure tank liquid level sensor 36 indicates ON and the negative pressure tank liquid level sensor 37 indicates ON. In these cases, ink is not supplied to the negative pressure tank 19 and ink is not delivered to the positive pressure tank 11.

When the positive pressure tank liquid level sensor 36 indicates OFF and the negative pressure tank liquid level sensor 37 indicates ON, the ink pump 25 is driven. Thus, ink is delivered from the negative pressure tank 19 to the positive pressure tank 11. The ink supply valve 42 is closed and the ink is not supplied to the negative pressure tank 19.

By such liquid level control, the ink delivery operation by the ink pump 25 and the ink supply operation by the ink supply unit 4 are performed separately in time.

Next, the pressure liquid level control will be described. As described above, the pressure liquid level control is formed of a combination of the pressure control and the liquid level control. That is, the pressure liquid level control is for controlling the operation of control elements, that is, the air pump 26, the positive pressure tank pressure regulation valve 14, the negative pressure tank pressure regulation valve 22, the ink supply valve 42, and the ink pump 25, according to a combination of the pressure condition and the liquid level condition.

There are provided 16 combinations of the pressure condition and the liquid level condition, which are denoted by respective combinatorial condition numbers K-1 to K-16 in FIGS. 5 and 6. As illustrated in FIGS. 5 and 6, in the pressure liquid level control, the control elements according to the pressure condition and the liquid level condition in one of the combinations are controlled.

However, when ink is supplied by the ink supply unit 4, target control elements are controlled such that an ink supply operation and a pressure regulation operation are performed separately in time.

Specifically, in the case of combinatorial condition number K-1, the ink supply valve 42 and the air pump 26 are controlled to perform later-described first separative operation. In the case of combinatorial condition number K-5, the ink supply valve 42, the air pump 26, and the positive pressure tank pressure regulation valve 14 are controlled to perform later-described second separative operation. In the case of combinatorial condition number K-9, the ink supply valve 42, the air pump 26, and the negative pressure tank pressure regulation valve 22 are controlled to perform later-described third separative operation. In the case of combinatorial condition number K-13, the ink supply valve 42, the positive pressure tank pressure regulation valve 14, and the negative pressure tank pressure regulation valve 22 are controlled to perform later-described fourth separative operation.

Also, when ink delivery operation is performed by the ink pump 25, target control elements are controlled such that an ink delivery operation and a pressure regulation operation are performed separately in time.

Specifically, in the case of combinatorial condition number K-3, the ink pump 25 and the air pump 26 are controlled to perform later-described fifth separative operation. In the case of combinatorial condition number K-7, the ink pump 25, the air pump 26, and the positive pressure tank pressure regulation valve 14 are controlled to perform later-described sixth separative operation. In the case of combinatorial condition number K-11, the ink pump 25, the air pump 26, and the negative pressure tank pressure regulation valve 22 are controlled to perform later-described seventh separative operation. In the case of combinatorial condition number K-15, the ink pump 25, the positive pressure tank pressure regulation valve 14, and the negative pressure tank pressure regulation valve 22 are controlled to perform later-described eighth separative operation.

When the pressure liquid level control is started in step S2 of FIG. 2, the controller 5 determines condition every predetermined time T. Specifically, the controller 5 determines pressure condition and liquid level condition based on the detected value Pk from the positive-pressure-side pressure sensor 16, the detected value Pf from the negative-pressure-side pressure sensor 24, an output signal of the positive pressure tank liquid level sensor 36, and an output signal of the negative pressure tank liquid level sensor 37. The controller 5 controls the control elements illustrated in FIGS. 5 and 6 based on the result of the determination. Here, as seen from the description of later-described separative operations (the first to eighth separative operations), each separative operation takes twice as long as the predetermined time T. Therefore, when a separative operation is performed, the interval until the subsequent condition determination is 2T.

When a print job is completed and the pressure liquid level control is terminated in step S6 of FIG. 2, the controller 5 stops the ink pump 25 and the air pump 26 when the pumps are being driven. When the positive pressure tank pressure regulation valve 14, the negative pressure tank pressure regulation valve 22, and the ink supply valve 42 are open, the controller 5 closes the valves.

Next, the first separative operation will be described.

Figure 7:
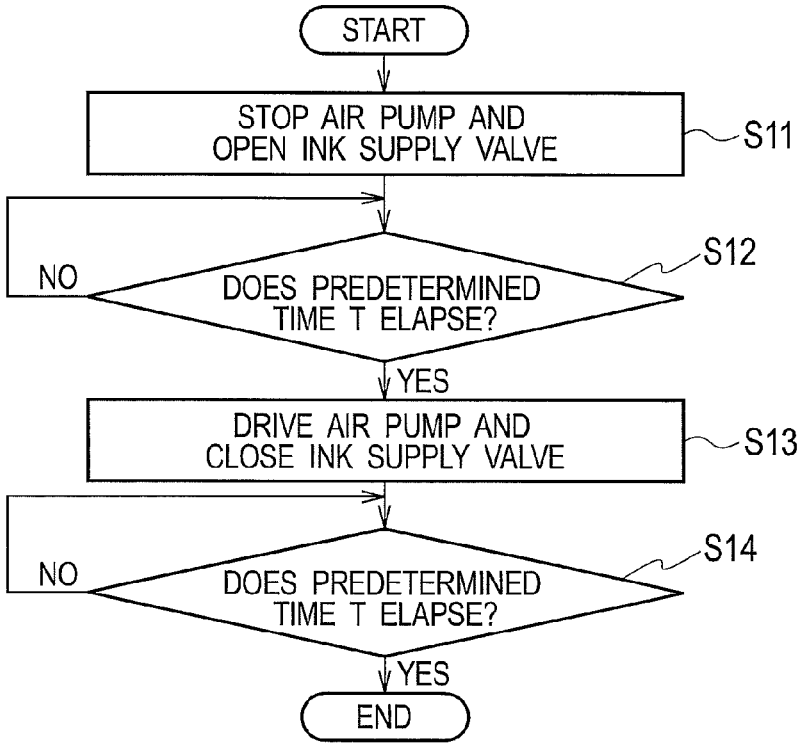
FIG. 7 is a flow chart for explaining a first separative operation.

FIG. 7 is a flow chart for explaining the first separative operation. The processing of the flow chart of FIG. 7 starts when the controller 5 determines that the current condition corresponds to the combinatorial condition number K-1, by making condition determination.

In step S11 of FIG. 7, the controller 5 stops the air pump 26. In addition, the controller 5 opens the ink supply valve 42. The opening of the ink supply valve 42 causes ink to be supplied to the negative pressure tank 19.

Here, as illustrated in FIG. 5, in the case of combinatorial condition number K-1, the controller 5 closes the positive pressure tank pressure regulation valve 14 and the negative pressure tank pressure regulation valve 22. Therefore, pressure regulation is not performed in a state where the air pump 26 is stopped.

Subsequently, in step S12, the controller 5 determines whether or not the predetermined time T has elapsed since the last condition determination was made. When it is determined that the predetermined time T has not elapsed (NO in step S12), the controller 5 repeats step S12.

When it is determined that the predetermined time T has elapsed (YES in step S12), the controller 5 starts to drive the air pump 26 in step S13. In addition, the controller 5 closes the ink supply valve 42. The pressure regulation is performed by driving the air pump 26 to decrease the pressure of the negative pressure tank 19 and to increase the pressure of the positive pressure tank 11. Also, the closing of the ink supply valve 42 causes ink supply to the negative pressure tank 19 to be stopped.

Subsequently, in step S14, the controller 5 determines whether or not the predetermined time T has elapsed since the processing in step S13. When it is determined that the predetermined time T has not elapsed (NO in step S14), the controller 5 repeats step S14.

When it is determined that the predetermined time T has elapsed (YES in step S14), the controller 5 terminates the first separative operation. The controller 5 makes the following condition determination.

Next, the second separative operation will be described.

Figure 8:
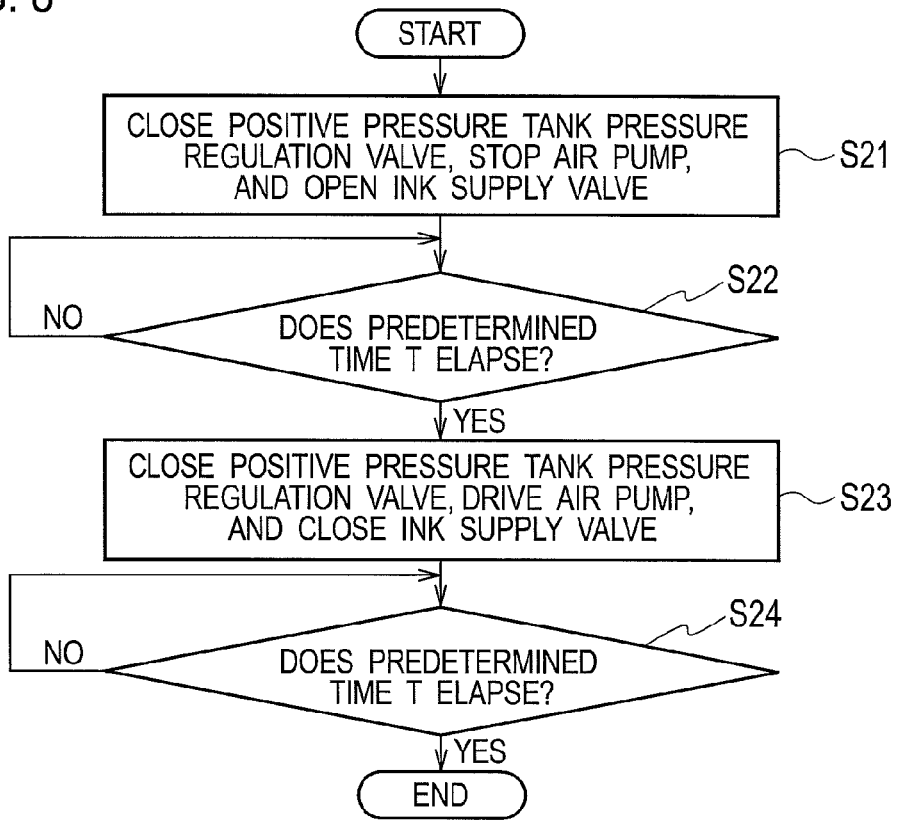
FIG. 8 is a flow chart for explaining a second separative operation.

FIG. 8 is a flow chart for explaining the second separative operation. The processing of the flow chart of FIG. 8 starts when the controller 5 determines that the current condition corresponds to the combinatorial condition number K-5, by making condition determination.

In step S21 of FIG. 8, the controller 5 closes the positive pressure tank pressure regulation valve 14. The controller 5 stops the air pump 26. The controller 5 opens the ink supply valve 42. The opening of the ink supply valve 42 causes ink to be supplied to the negative pressure tank 19.

Here, as illustrated in FIG. 5, in the case of combinatorial condition number K-5, the controller 5 closes the negative pressure tank pressure regulation valve 22. Therefore, the pressure regulation is not performed in a state where the positive pressure tank pressure regulation valve 14 is also closed and the air pump 26 is stopped.

Subsequently, in step S22, the controller 5 determines whether or not the predetermined time T has elapsed since the last condition determination was made. When it is determined that the predetermined time T has not elapsed (NO in step S22), the controller 5 repeats step S22.

When it is determined that the predetermined time T has elapsed (YES in step S22), the controller 5 opens the positive pressure tank pressure regulation valve 14 and starts to drive the air pump 26 in step S23. In addition, the controller 5 closes the ink supply valve 42. The opening of the positive pressure tank pressure regulation valve 14 causes the pressure of the positive pressure tank 11 to decrease, and the driving of the air pump 26 causes the pressure of the negative pressure tank 19 to decrease. In this manner, the pressure regulation is performed. Also, the closing of the ink supply valve 42 causes ink supply to the negative pressure tank 19 to be stopped.

Subsequently, in step S24, the controller 5 determines whether or not the predetermined time T has elapsed since the processing in step S23. When it is determined that the predetermined time T has not elapsed (NO in step S24), the controller 5 repeats step S24.

When it is determined that the predetermined time T has elapsed (YES in step S24), the controller 5 terminates the second separative operation. The controller 5 then makes the following condition determination.

Next, the third separative operation will be described.

Figure 9:
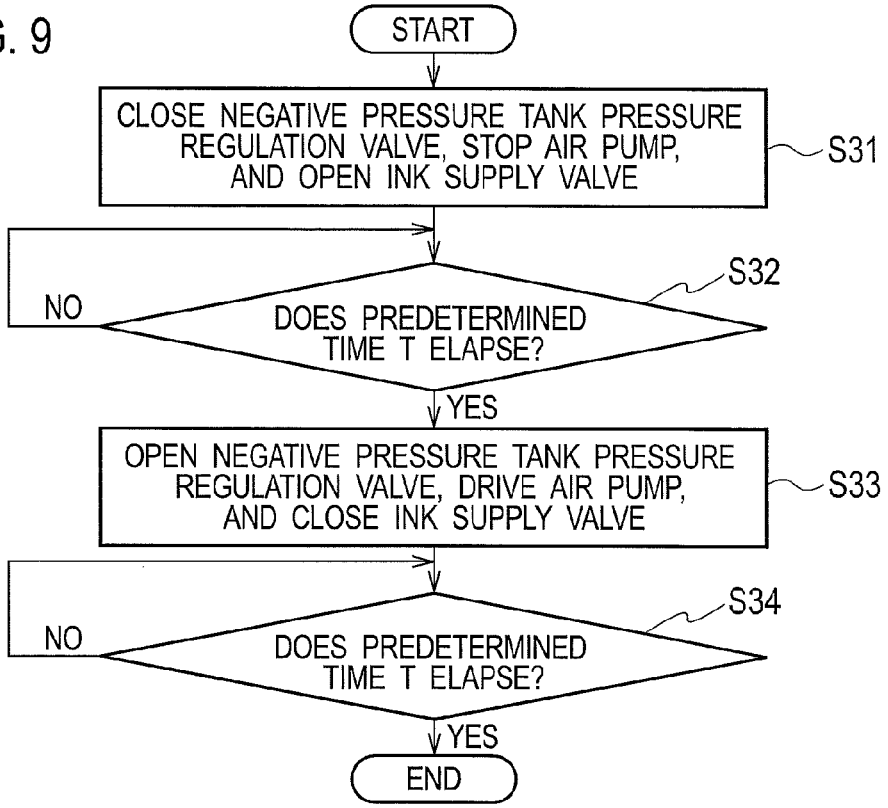
FIG. 9 is a flow chart for explaining a third separative operation.

FIG. 9 is a flow chart for explaining the third separative operation. The processing of the flow chart of FIG. 9 starts when the controller 5 determines that the current condition corresponds to the combinatorial condition number K-9, by making condition determination.

In step S31 of FIG. 9, the controller 5 closes the negative pressure tank pressure regulation valve 22. The controller 5 stops the air pump 26. The controller 5 opens the ink supply valve 42. The opening of the ink supply valve 42 causes ink to be supplied to the negative pressure tank 19.

Here, as illustrated in FIG. 6, in the case of combinatorial condition number K-9, the controller 5 closes the positive pressure tank pressure regulation valve 14. Therefore, the pressure regulation is not performed in a state where the negative pressure tank pressure regulation valve 22 is also closed and the air pump 26 is stopped.

Subsequently, in step S32, the controller 5 determines whether or not the predetermined time T has elapsed since the last condition determination was made. When it is determined that the predetermined time T has not elapsed (NO in step S32), the controller 5 repeats step S32.

When it is determined that the predetermined time T has elapsed (YES in step S32), the controller 5 opens the negative pressure tank pressure regulation valve 22 and starts to drive the air pump 26 in step S33. In addition, the controller 5 closes the ink supply valve 42. The opening of the negative pressure tank pressure regulation valve 22 causes the pressure of the negative pressure tank 19 to increase, and the driving of the air pump 26 causes the pressure of the positive pressure tank 11 to increase. In this manner, the pressure regulation is performed. Also, the closing of the ink supply valve 42 causes ink supply to the negative pressure tank 19 to be stopped.

Subsequently, in step S34, the controller 5 determines whether or not the predetermined time T has elapsed since the processing in step S33. When it is determined that the predetermined time T has not elapsed (NO in step S34), the controller 5 repeats step S34.

When it is determined that the predetermined time T has elapsed (YES in step S34), the controller 5 terminates the third separative operation. The controller 5 then makes the following condition determination.

Next, the fourth separative operation will be described.

Figure 10:
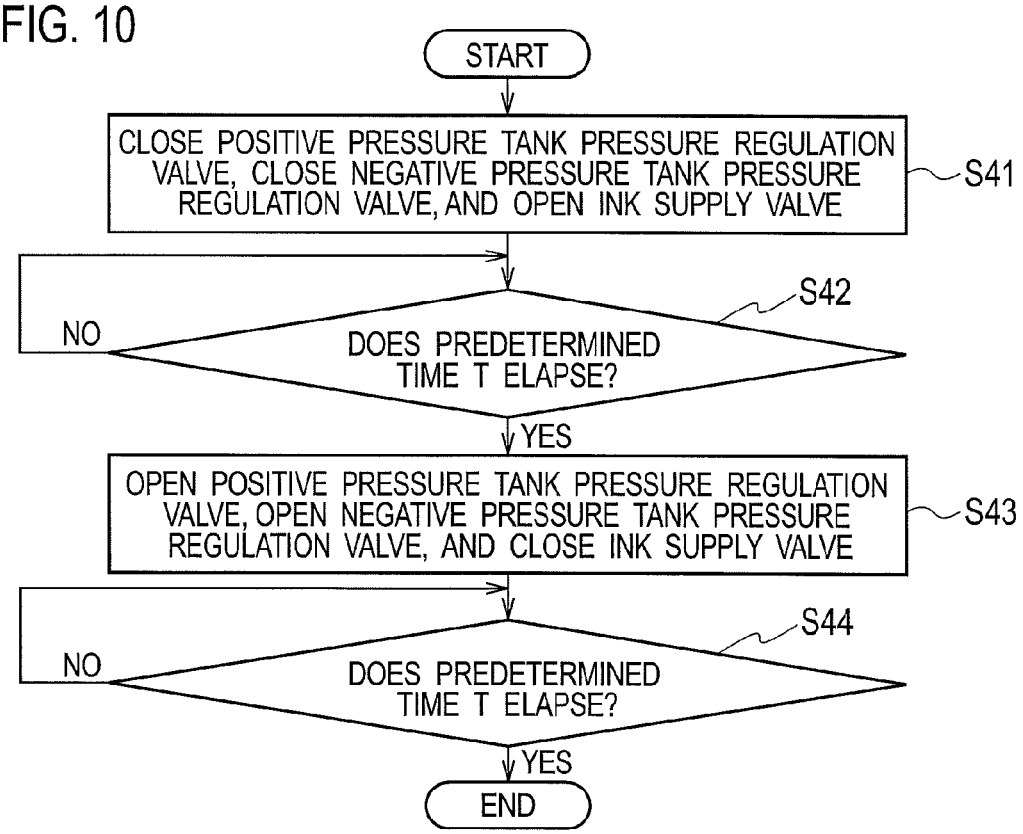
FIG. 10 is a flow chart for explaining a fourth separative operation.

FIG. 10 is a flow chart for explaining the fourth separative operation. The processing of the flow chart of FIG. 10 starts when the controller 5 determines that the current condition corresponds to the combinatorial condition number K-13, by making condition determination.

In step S41 of FIG. 10, the controller 5 closes the positive pressure tank pressure regulation valve 14 and the negative pressure tank pressure regulation valve 22. In addition, the controller 5 opens the ink supply valve 42. The opening of the ink supply valve 42 causes ink to be supplied to the negative pressure tank 19.

Here, as illustrated in FIG. 6, in the case of combinatorial condition number K-13, the controller 5 stops the air pump 26. Therefore, the pressure regulation is not performed in a state where the positive pressure tank pressure regulation valve 14 and the negative pressure tank pressure regulation valve 22 are closed.

Subsequently, in step S42, the controller 5 determines whether or not the predetermined time T has elapsed since the last condition determination was made. When it is determined that the predetermined time T has not elapsed (NO in step S42), the controller 5 repeats step S42.

When it is determined that the predetermined time T has elapsed (YES in step S42), the controller 5 opens the positive pressure tank pressure regulation valve 14 and the negative pressure tank pressure regulation valve 22 in step S43. In addition, the controller 5 closes the ink supply valve 42. The opening of the positive pressure tank pressure regulation valve 14 and the negative pressure tank pressure regulation valve 22 causes the pressure of the positive pressure tank 11 to decrease and the pressure of the negative pressure tank 19 to increase. In this manner, the pressure regulation is performed. The closing of the ink supply valve 42 causes ink supply to the negative pressure tank 19 to be stopped.

Subsequently, in step S44, the controller 5 determines whether or not the predetermined time T has elapsed since the processing in step S43. When it is determined that the predetermined time T has not elapsed (NO in step S44), the controller 5 repeats step S44.

When it is determined that the predetermined time T has elapsed (YES in step S44), the controller 5 terminates the fourth separative operation. The controller 5 then makes the following condition determination.

By the above-described first to fourth separative operations, the ink supply operation and the pressure regulation operation are performed separately in time when the conditions for the ink supply unit 4 to perform the ink supply operation are satisfied.

Next, the fifth separative operation will be described.

Figure 11:
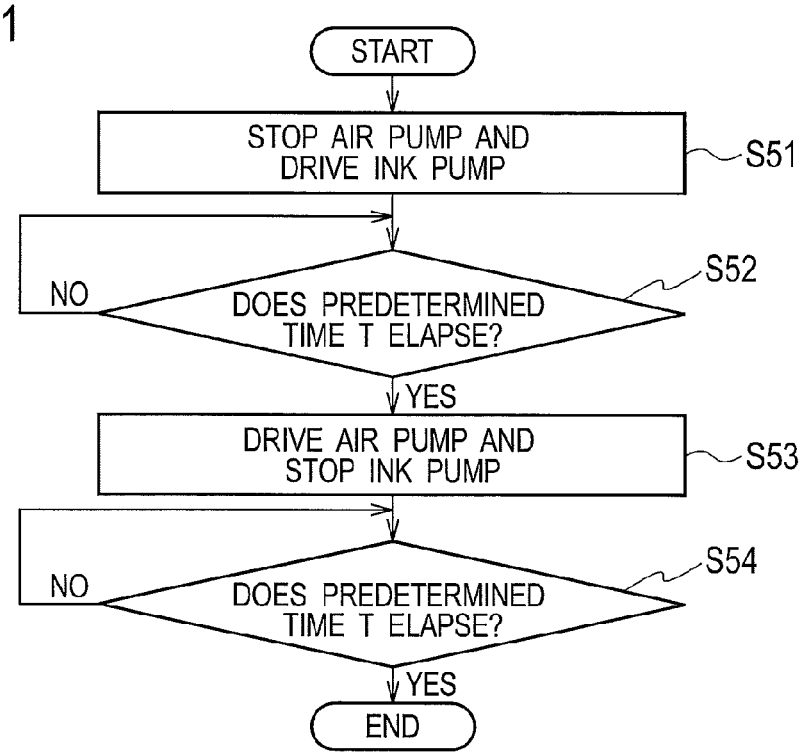
FIG. 11 is a flow chart for explaining a fifth separative operation.

FIG. 11 is a flow chart for explaining the fifth separative operation. The processing of the flow chart of FIG. 11 starts when the controller 5 determines that the current condition corresponds to the combinatorial condition number K-3, by making condition determination.

In step S51 of FIG. 11, the controller 5 stops the air pump 26. In addition, the controller 5 causes the ink pump 25 to be driven. The driving of the ink pump 25 causes ink to be delivered from the negative pressure tank 19 to the positive pressure tank 11.

Here, as illustrated in FIG. 5, in the case of combinatorial condition number K-3, the controller 5 closes the positive pressure tank pressure regulation valve 14 and the negative pressure tank pressure regulation valve 22. Therefore, the pressure regulation is not performed in a state where the air pump 26 is stopped.

Subsequently, in step S52, the controller 5 determines whether or not the predetermined time T has elapsed since the last condition determination was made. When it is determined that the predetermined time T has not elapsed (NO in step S52) and the controller 5 repeat step S52.

When it is determined that the predetermined time T has elapsed (YES in step S62), the controller 5 starts to drive the air pump 26 in step S53. In addition, the controller 5 stops the ink pump 25. The driving of the air pump 26 causes the pressure of the negative pressure tank 19 to decrease and the pressure of the positive pressure tank 11 to increase, thereby performing the pressure regulation. The stopping of the ink pump 25 causes ink delivery from the negative pressure tank 19 to the positive pressure tank 11 to be stopped.

Subsequently, in step S54, the controller 5 determines whether or not the predetermined time T has elapsed since the processing in step S53. When it is determined that the predetermined time T has not elapsed (NO in step S54), the controller 5 repeats step S54.

When it is determined that the predetermined time T has elapsed (YES in step S54), the controller 5 terminates the fifth separative operation. The controller 5 then makes the following condition determination, Next, the sixth separative operation will be described.

Figure 12:
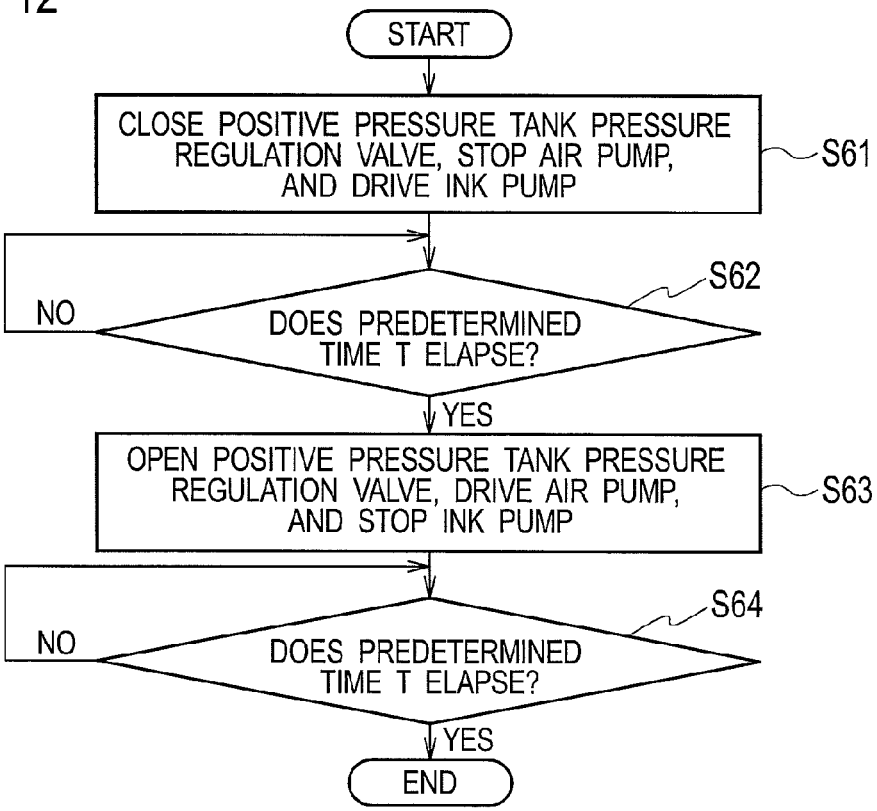
FIG. 12 is a flow chart for explaining a sixth separative operation.

FIG. 12 is a flow chart for explaining the sixth separative operation. The processing of the flow chart of FIG. 12 starts when the controller 5 determines that the current condition corresponds to the combinatorial condition number K-7, by making condition determination.

In step S61 of FIG. 12, the controller 5 closes the positive pressure tank pressure regulation valve 14. In addition, the controller 5 stops the air pump 26. The controller 5 also causes the ink pump 25 to be driven. The driving of the ink pump 25 causes ink to be delivered from the negative pressure tank 19 to the positive pressure tank 11.

Here, as illustrated in FIG. 5, in the case of combinatorial condition number K-7, the controller 5 closes the negative pressure tank pressure regulation valve 22. Therefore, the pressure regulation is not performed in a state where the positive pressure tank pressure regulation valve 14 is also closed and the air pump 26 is stopped.

Subsequently, in step S62, the controller 5 determines whether or not the predetermined time T has elapsed since the last condition determination was made. When it is determined that the predetermined time T has not elapsed (NO in step S62), the controller 5 repeats step S62.

When it is determined that the predetermined time T has elapsed (YES in step S62), the controller 5 opens the positive pressure tank pressure regulation valve 14 and starts to drive the air pump 26 in step S63. In addition, the controller 5 stops the ink pump 25. The opening of the positive pressure tank pressure regulation valve 14 causes the pressure of the positive pressure tank 11 to decrease, and the driving of the air pump 26 causes the pressure of the negative pressure tank 19 to decrease. In this manner, the pressure regulation is performed. The stopping of the ink pump 25 causes ink delivery from the negative pressure tank 19 to the positive pressure tank 11 to be stopped.

Subsequently, in step S64, the controller 5 determines whether or not the predetermined time T has elapsed since the processing in step S63. When it is determined that the predetermined time T has not elapsed (NO in step S64), the controller 5 repeats step S64.

When it is determined that the predetermined time T has elapsed (YES in step S64), controller 5 terminates the sixth separative operation. The controller 5 then makes the following condition determination.

Next, the seventh separative operation will be described.

Figure 13:
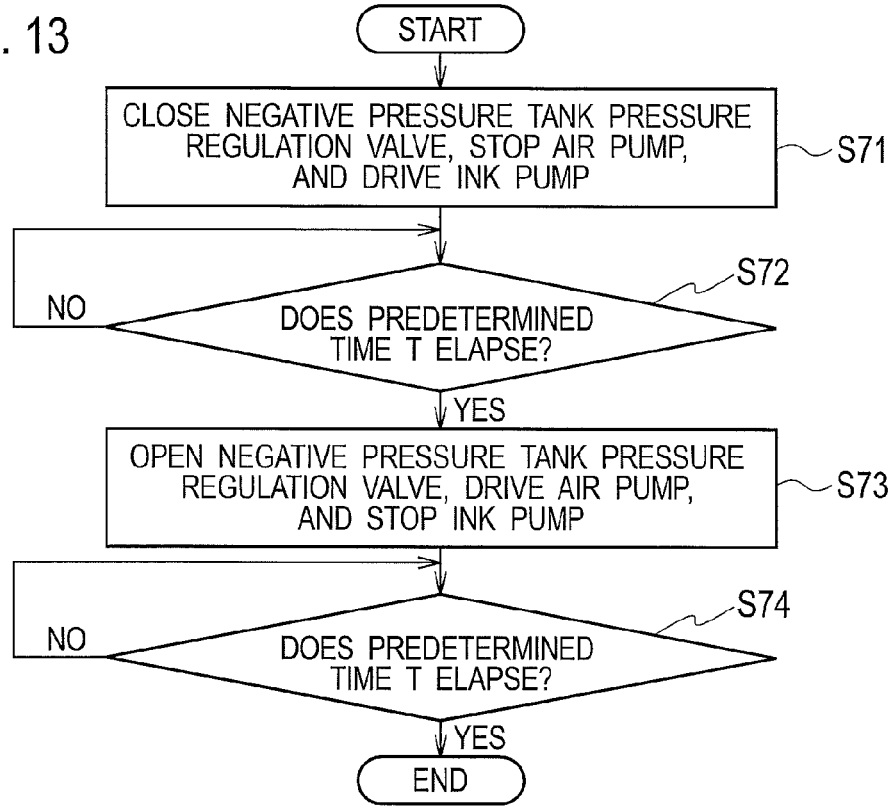
FIG. 13 is a flow chart for explaining a seventh separative operation.

FIG. 13 is a flow chart for explaining the seventh separative operation. The processing of the flow chart of FIG. 13 starts when the controller 5 determines that the current condition corresponds to the combinatorial condition number K-11, by making condition determination.

In step S71 of FIG. 13, the controller 5 closes the negative pressure tank pressure regulation valve 22. In addition, the controller 5 stops the air pump 26. The controller 5 also causes the ink pump 25 to be driven. The driving of the ink pump 25 causes ink to be delivered from the negative pressure tank 19 to the positive pressure tank 11.

Here, as illustrated in FIG. 6, in the case of combinatorial condition number K-11, the controller 5 closes the positive pressure tank pressure regulation valve 14. Therefore, the pressure regulation is not performed in a state where the negative pressure tank pressure regulation valve 22 is also closed and the air pump 26 is stopped.

Subsequently, in step S72, the controller 5 determines whether or not the predetermined time T has elapsed since the last condition determination was made. When it is determined that the predetermined time T has not elapsed (NO in step S72), the controller 5 repeats step S72.

When it is determined that the predetermined time T has elapsed (YES in step S72), the controller 5 opens the negative pressure tank pressure regulation valve 22 and starts to drive the air pump 26 in step S73. In addition, the controller 5 stops the ink pump 25. The opening of the negative pressure tank pressure regulation valve 22 causes the pressure of the negative pressure tank 19 to increase, and the driving of the air pump 26 causes the pressure of the positive pressure tank 11 to increase. In this manner, the pressure regulation is performed. The stopping of the ink pump 25 causes ink delivery from the negative pressure tank 19 to the positive pressure tank 11 to be stopped.

Subsequently, in step S74, the controller 5 determines whether or not the predetermined time T has elapsed since the processing in step S73. When it is determined that the predetermined time T has not elapsed (NO in step S74), the controller 5 repeats step S74.

When it is determined that the predetermined time T has elapsed (YES in step S74), controller 5 terminates the seventh separative operation. The controller 5 then makes the following condition determination.

Next, the eighth separative operation will be described.

Figure 14:
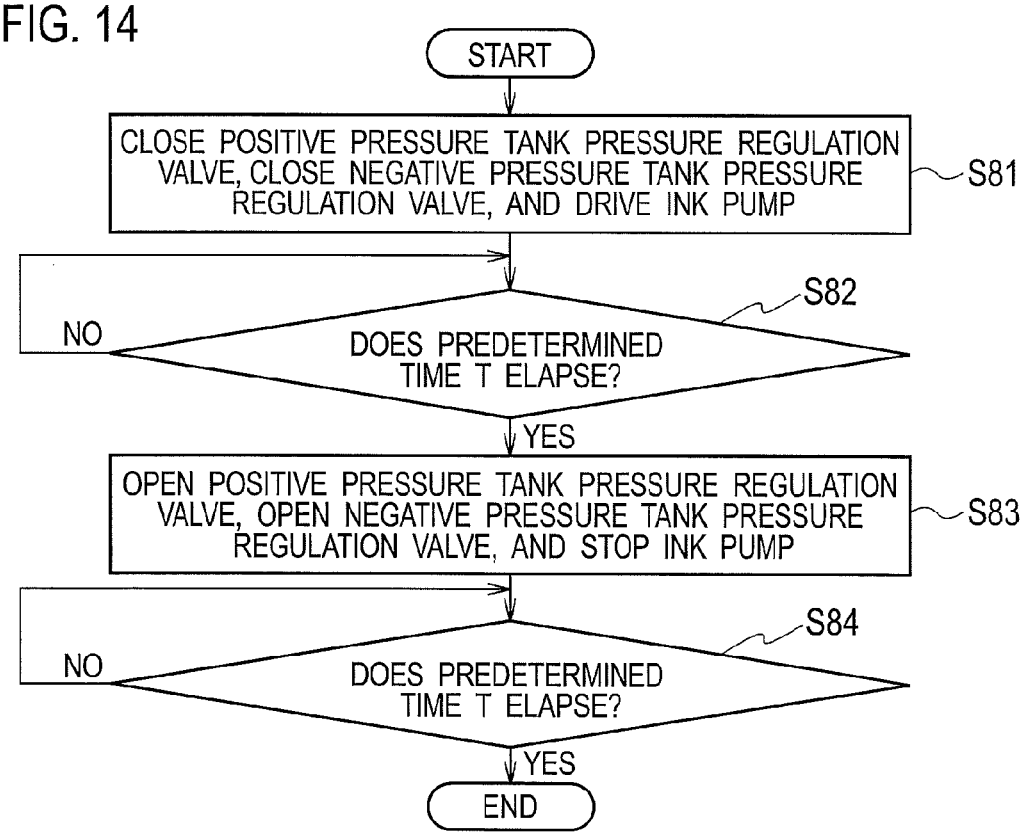
FIG. 14 is a flow chart for explaining an eighth separative operation.

FIG. 14 is a flow chart for explaining the eighth separative operation. The processing of the flow chart of FIG. 14 starts when the controller 5 determines that the current condition corresponds to the combinatorial condition number K-15, by making condition determination.

In step S81 of FIG. 14, the controller 5 closes the positive pressure tank pressure regulation valve 14 and the negative pressure tank pressure regulation valve 22. In addition, the controller 5 causes the ink pump 25 to be driven. The driving of the ink pump 25 causes ink to be delivered from the negative pressure tank 19 to the positive pressure tank 11.

Here, as illustrated in FIG. 6, in the case of combinatorial condition number K-15, the controller 5 stops the air pump 26. Therefore, the pressure regulation is not performed in a state where the positive pressure tank pressure regulation valve 14 and the negative pressure tank pressure regulation valve 22 are closed.

Subsequently, in step S82, the controller 5 determines whether or not the predetermined time T has elapsed since the last condition determination was made. When it is determined that the predetermined time T has not elapsed (NO in step S82), the controller 5 repeats step S82.

When it is determined that the predetermined time T has elapsed (YES in step S82), the controller 5 opens the positive pressure tank pressure regulation valve 14 and the negative pressure tank pressure regulation valve 22 in step S83. In addition, the controller 5 stops the ink pump 25. The opening of the positive pressure tank pressure regulation valve 14 and the negative pressure tank pressure regulation valve 22 causes the pressure of the positive pressure tank 11 to decrease and the pressure of the negative pressure tank 19 to increase. In this manner, the pressure regulation is performed. The stopping of the ink pump 25 causes ink delivery from the negative pressure tank 19 to the positive pressure tank 11 to be stopped.

Subsequently, in step S84, the controller 5 determines whether or not the predetermined time T has elapsed since the processing in step S83. When it is determined that the predetermined time T has not elapsed (NO in step S84), the controller 5 repeats step S84.

When it is determined that the predetermined time T has elapsed (YES in step S84), the controller 5 terminates the eighth separative operation. The controller 5 then makes the following condition determination.

By the above-described fifth to eighth separative operations, the ink delivery operation and the pressure regulation operation are performed separately in time when the conditions for the ink pump 25 to perform the ink delivery operation are satisfied.

As described above, in the inkjet printer 1, the controller 5 performs control such that the ink delivery operation by the ink pump 25, the ink supply operation by the ink supply unit 4, and the pressure regulation operation by the air pump 26, the positive pressure tank pressure regulation valve 14, and the negative pressure tank pressure regulation valve 22 are performed separately in time. Thus, it is possible to suppress an increase in the nozzle pressure variation due to repeated factors of variation in the pressures of the positive pressure tank 11 and the negative pressure tank 19. Consequently, degradation of printed image quality can be reduced.

It is to be noted that the operations belonging to each of only one or two combinations out of the combinations (three ways) of two operations taken from the ink delivery operation, the ink supply operation, and the pressure regulation operation may be performed separately in time. For instance, only between the ink delivery operation and the pressure regulation operation, both operations may be performed separately in time. Even in this case, the effect is obtained that degradation of printed image quality due to a nozzle pressure variation can be reduced. As might be expected, as the number of combinations of operations separated in time increases, degradation of printed image quality can be further reduced.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head including a nozzle configured to eject ink;

a positive pressure tank configured to store the ink to be supplied to the inkjet head;

a negative pressure tank configured to receive the ink not consumed by the inkjet head;

an ink deliverer configured to deliver the ink from the negative pressure tank to the positive pressure tank;

a pressure regulator configured to regulate pressures of the positive pressure tank and the negative pressure tank, and including an air pump configured to deliver air from the negative pressure tank to the positive pressure tank; and a controller configured to control the ink deliverer and the pressure regulator to perform an ink delivery operation by the ink deliverer and a pressure regulation operation by the pressure regulator separately in time.

2. The inkjet printer according to claim 1, further comprising:

an ink supplier configured to supply the ink to the negative pressure tank, wherein the controller is configured to control the ink supplier and the pressure regulator to perform an ink supply operation by the ink supplier and the pressure regulation operation by the pressure regulator separately in time.

3. The inkjet printer according to claim 1, further comprising:

a negative pressure sensor configured to detect a pressure in the negative pressure tank; and a positive pressure sensor configured to detect a pressure in the positive pressure tank.

4. The inkjet printer according to claim 1, further comprising:

a negative pressure tank air opening pipe to expose the negative pressure tank to an atmospheric pressure, wherein the pressure regulator further includes a negative pressure tank pressure regulation pipe providing a flow path of air for regulating the pressure in the negative pressure tank, the negative pressure tank pressure regulation pipe being different than the negative pressure tank air opening pipe, the negative pressure tank pressure regulation pipe having a higher flow path resistance than a flow path resistance of the negative pressure tank air opening pipe, and the negative pressure tank pressure regulation pipe has one end connected to an air layer of the negative pressure tank and another end communicating with the atmosphere.

5. The inkjet printer according to claim 1, further comprising:

a positive pressure tank air opening pipe to expose the positive pressure tank to an atmospheric pressure, wherein the pressure regulator further includes a positive pressure tank pressure regulation pipe providing a flow path of air for regulating the pressure in the positive pressure tank, the positive pressure tank pressure regulation pipe being different than positive pressure tank air opening pipe, the positive pressure tank pressure regulation pipe has a higher flow path resistance than a flow path resistance of the positive pressure tank air opening pipe, and the positive pressure tank pressure regulation pipe has one end connected to an air layer of the positive pressure tank and another end communicating with the atmosphere.

6. The inkjet printer according to claim 1, wherein the pressure regulator is configured to maintain a set pressure designated for each of the positive pressure tank and the negative pressure tank during ink circulation.

7. The inkjet printer according to claim 1, wherein the pressure regulator further includes an air pump pipe having one end connected to an air layer of the negative pressure tank and another end connected to an air layer of the positive pressure tank, and the air pump is arranged midway along the air pump pipe.

8. The inkjet printer according to claim 2, wherein the controller is configured to control the ink supplier and the ink deliverer to perform the ink supply operation by the ink supplier and the ink delivery operation by the ink deliverer separately in time.

9. An inkjet printer comprising:

an inkjet head including a nozzle configured to eject ink;

a positive pressure tank configured to store the ink to be supplied to the inkjet head;

a negative pressure tank configured to receive the ink not consumed by the inkjet head;

an ink deliverer configured to deliver the ink from the negative pressure tank to the positive pressure tank;

an ink supplier configured to supply the ink to the negative pressure tank;

a pressure regulator configured to regulate pressures of the positive pressure tank and the negative pressure tank, and including an air pump configured to deliver air from the negative pressure tank to the positive pressure tank; and a controller configured to control the ink supplier and the pressure regulator to perform an ink supply operation by the ink supplier and a pressure regulation operation by the pressure regulator separately in time.

10. The inkjet printer according to claim 9, wherein the controller is configured to control the ink supplier and the ink deliverer to perform the ink supply operation by the ink supplier and an ink delivery operation by the ink deliverer separately in time.

11. The inkjet printer according to claim 9, further comprising:

a negative pressure sensor configured to detect a pressure in the negative pressure tank; and a positive pressure sensor configured to detect a pressure in the positive pressure tank.

12. The inkjet printer according to claim 9, further comprising:

a negative pressure tank air opening pipe to expose the negative pressure tank to an atmospheric pressure, wherein the pressure regulator further includes a negative pressure tank pressure regulation pipe providing a flow path of air for regulating the pressure in the negative pressure tank, the negative pressure tank pressure regulation pipe being different than negative pressure tank air opening pipe, the negative pressure tank pressure regulation pipe having a higher flow path resistance than a flow path resistance of the negative pressure tank air opening pipe, and the negative pressure tank pressure regulation pipe has one end connected to an air layer of the negative pressure tank and another end communicating with the atmosphere.

13. The inkjet printer according to claim 9, further comprising:

a positive pressure tank air opening pipe to expose the positive pressure tank to an atmospheric pressure, wherein the pressure regulator further includes a positive pressure tank pressure regulation pipe providing a flow path of air for regulating the pressure in the positive pressure tank, the positive pressure tank pressure regulation pipe being different than positive pressure tank air opening pipe, the positive pressure tank pressure regulation pipe has a higher flow path resistance than a flow path resistance of the positive pressure tank air opening pipe, and the positive pressure tank pressure regulation pipe has one end connected to an air layer of the positive pressure tank and another end communicating with the atmosphere.

14. The inkjet printer according to claim 9, wherein the pressure regulator is configured to maintain a set pressure designated for each of the positive pressure tank and the negative pressure tank during ink circulation.

15. The inkjet printer according to claim 9, wherein the pressure regulator further includes an air pump pipe having one end connected to an air layer of the negative pressure tank and another end connected to an air layer of the positive pressure tank, and the air pump is arranged midway along the air pump pipe.

* * * * *